US011598145B2

(12) United States Patent
Huang et al.

(10) Patent No.: US 11,598,145 B2
(45) Date of Patent: Mar. 7, 2023

(54) WINDOW SHADE AND ACTUATING SYSTEM THEREOF

(71) Applicant: Teh Yor Co., Ltd., New Taipei (TW)

(72) Inventors: Chung-Chen Huang, New Taipei (TW); Kuan-Yu Liu, New Taipei (TW)

(73) Assignee: Teh Yor Co., Ltd., New Taipei (TW)

( * ) Notice: Subject to any disclaimer, the term of this patent is extended or adjusted under 35 U.S.C. 154(b) by 133 days.

(21) Appl. No.: 17/194,195

(22) Filed: Mar. 5, 2021

(65) Prior Publication Data

US 2021/0277712 A1 Sep. 9, 2021

Related U.S. Application Data

(60) Provisional application No. 62/987,125, filed on Mar. 9, 2020.

(51) Int. Cl.
*E06B 9/322* (2006.01)
*E06B 9/262* (2006.01)

(52) U.S. Cl.
CPC ..... *E06B 9/322* (2013.01); *E06B 9/262* (2013.01); *E06B 2009/2627* (2013.01)

(58) Field of Classification Search
CPC ..... E06B 9/322; E06B 9/262; E06B 9/326; E06B 2009/2627
See application file for complete search history.

(56) References Cited

U.S. PATENT DOCUMENTS 5,167,269 A * 12/1992 Abo ..... F16D 67/02 160/321
5,566,741 A * 10/1996 Ogawara ..... E06B 9/90 160/297

(Continued)

FOREIGN PATENT DOCUMENTS

EP 3199742 A1 8/2017
WO WO-2011090051 A1 * 7/2011 ..... E06B 9/262

(Continued)

OTHER PUBLICATIONS

Taiwanese Office Action, dated Nov. 9, 2021, in a counterpart Taiwanese patent application, No. TW 110108236. (English translation of the search report is appended after the Chinese language document in the same PDF).

(Continued)

*Primary Examiner* — Johnnie A. Shablack
(74) *Attorney, Agent, or Firm* — Chen Yoshimura LLP

(57) ABSTRACT

An actuating system for a window shade includes an axle coupling part rotatable for raising or lowering a bottom part of a window shade, an arresting part and an arrester coupling part connected with each other, the arresting part having a braking state and a release state, a clutching part carried with the arrester coupling part and movable relative to the arrester coupling part between a retracted state where the clutching part is disengaged from the axle coupling part and an extended state where the clutching part is engaged with the axle coupling part, and an actuating wheel movably linked to the clutching part, the actuating wheel being rotatable in a first direction to urge the clutching part to move from the retracted state to the extended state, and in an opposite second direction to urge the clutching part to move from the extended state to the retracted state.

17 Claims, 18 Drawing Sheets

(56) References Cited

U.S. PATENT DOCUMENTS 6,685,592 B2 * 2/2004 Fraczek ..... E06B 9/44 475/14
8,342,309 B2 * 1/2013 Takagi ..... E06B 9/322 192/223.4
8,356,653 B2 * 1/2013 Fu-Lai ..... E06B 9/322 160/84.05
8,573,281 B2 * 11/2013 Drew ..... E06B 9/262 160/84.05
9,062,492 B2 * 6/2015 Yu ..... E06B 9/322
9,187,951 B2 * 11/2015 Yu ..... E06B 9/78
9,765,864 B2 * 9/2017 Yu ..... E06B 9/78
10,107,032 B2 * 10/2018 Chen ..... F16H 19/06
10,472,887 B2 * 11/2019 Hebeisen ..... E06B 9/42
RE48,355 E * 12/2020 Chen ..... F16H 29/12
2005/0072534 A1 * 4/2005 Braybrook ..... F16D 41/20 160/167 R
2006/0096826 A1 * 5/2006 Murrell ..... F16D 41/06 192/38
2006/0191650 A1 * 8/2006 Takebayashi ..... E06B 9/78 160/320
2012/0080285 A1 * 4/2012 Chen ..... F16D 11/14 192/71
2012/0285632 A1 * 11/2012 Kataoka ..... E06B 9/262 160/126
2013/0220561 A1 * 8/2013 Yu ..... E06B 9/322 160/405
2014/0290871 A1 * 10/2014 Muto ..... E06B 9/262 160/84.01
2015/0007946 A1 * 1/2015 Yu ..... E06B 9/322 160/84.02
2015/0354275 A1 * 12/2015 Huang ..... E06B 9/324 160/368.1
2016/0010390 A1 * 1/2016 Smith ..... E06B 9/42 160/315
2016/0017964 A1 * 1/2016 Yu ..... E06B 9/32 160/168.1 P
2017/0108052 A1 * 4/2017 Littlefield ..... F16D 11/14
2019/0170198 A1 * 6/2019 Kimes ..... F16H 63/304
2021/0222489 A1 * 7/2021 Huang ..... E06B 9/262
2021/0277712 A1 * 9/2021 Huang ..... E06B 9/322
2022/0106832 A1 * 4/2022 Zhou ..... E06B 9/42
2022/0251900 A1 * 8/2022 Huang ..... E06B 9/322

FOREIGN PATENT DOCUMENTS

WO WO-2012137731 A1 * 10/2012 ..... E06B 9/24
WO 2020009325 A1 1/2020

OTHER PUBLICATIONS

International Search Report in the parent PCT application No. PCT/US2021/021251, dated Aug. 6, 2021.
Written Opinion in the parent PCT application No. PCT/US2021/021251, dated Aug. 6, 2021.

* cited by examiner

WINDOW SHADE AND ACTUATING SYSTEM THEREOF

CROSS-REFERENCE TO RELATED APPLICATION(S)

This application claims priority to U.S. provisional patent application No. 62/987,125 filed on Mar. 9, 2020, the disclosure of which is incorporated herein by reference.

BACKGROUND

1. Field of the Invention

The present invention relates to window shades, and actuating systems used in window shades.

2. Description of the Related Art

Some window shades may use an operating cord for raising a bottom part of the window shade and a wand for lowering the bottom part. More specifically, the operating cord may be pulled downward to drive a rotary part in rotation, which can be transmitted to a drive axle so that the drive axle can rotate for winding a suspension cord connected with the bottom part. When a user rotates the wand, an arrester coupled to the wand can release the drive axle, which can accordingly rotate as the bottom part lowers under gravity action.

The aforementioned type of window shades requires a user to operate two separate parts for lowering and raising the bottom part, and uses a control system that is relatively complex in construction.

Therefore, there is a need for an improved actuating system that can be used in window shades and address at least the foregoing issues.

SUMMARY

The present application describes a window shade and an actuating system for use with the window shade that can address the foregoing issues.

According to an embodiment, an actuating system for a window shade includes an axle coupling part rotatable for raising or lowering a bottom part of a window shade, an arresting part and an arrester coupling part connected with each other, the arresting part having a braking state and a release state, a clutching part carried with the arrester coupling part, the clutching part being movable relative to the arrester coupling part between a retracted state where the clutching part is disengaged from the axle coupling part and an extended state where the clutching part is engaged with the axle coupling part, and an actuating wheel movably linked to the clutching part, the actuating wheel being rotatable in a first direction to urge the clutching part to move from the retracted state to the extended state, and in a second direction opposite to the first direction to urge the clutching part to move from the extended state to the retracted state.

Moreover, the application describes a window shade that incorporates the actuating system.

DETAILED DESCRIPTION OF THE EMBODIMENTS

Figure 1:
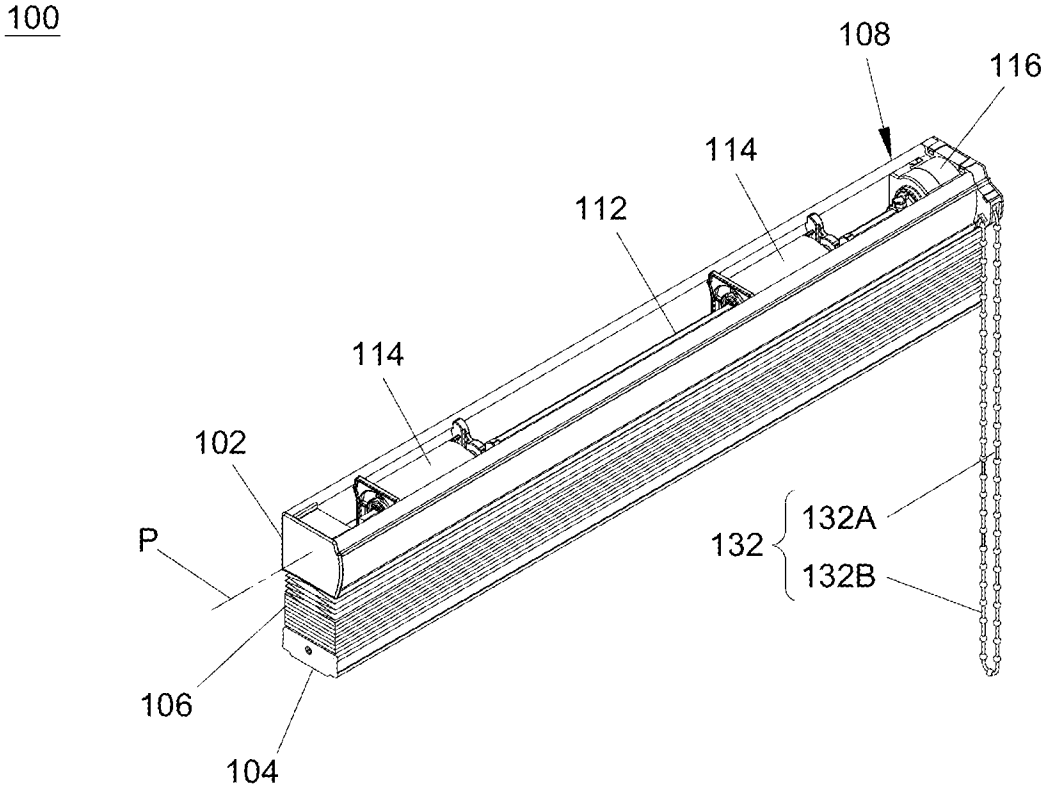
FIG. 1 is a perspective view illustrating an embodiment of a window shade.
Figure 2:
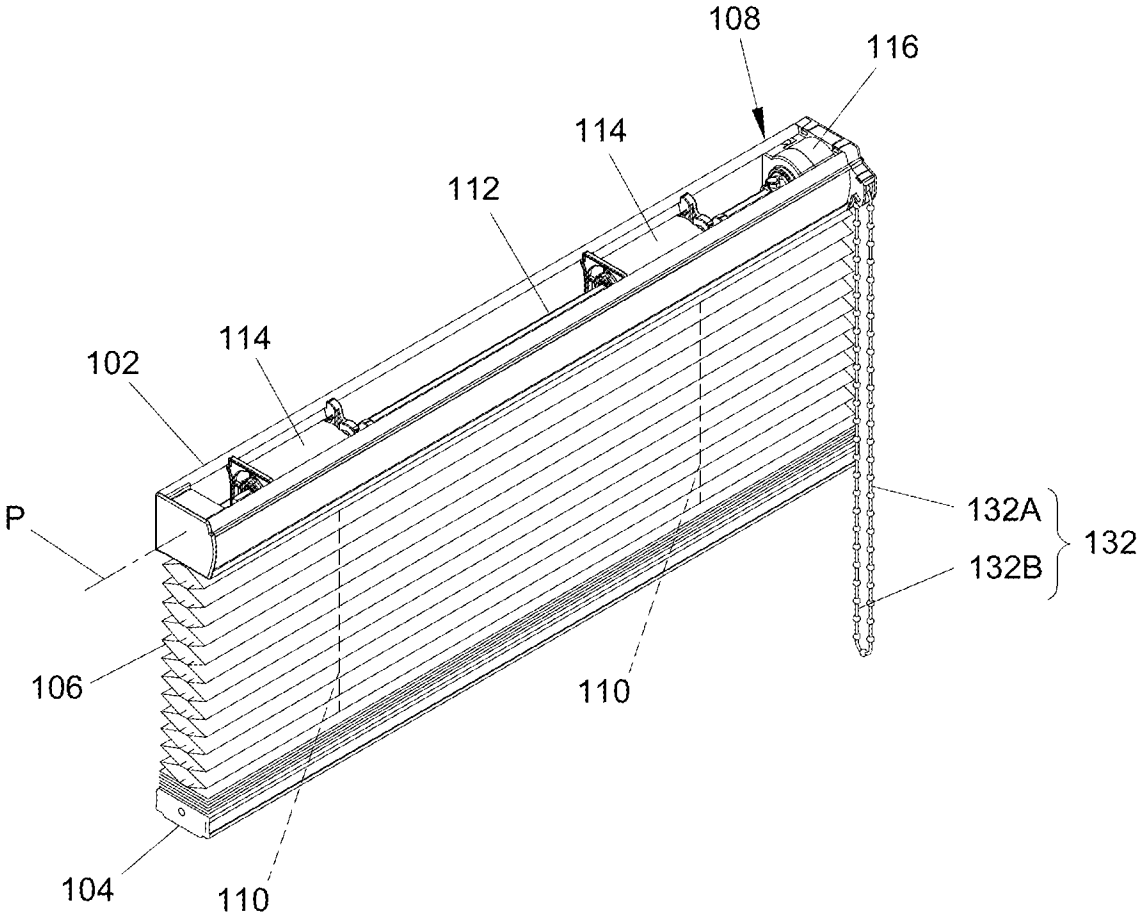
FIG. 2 is a perspective view illustrating the window shade having a bottom part lowered from a head rail.
Figure 3:
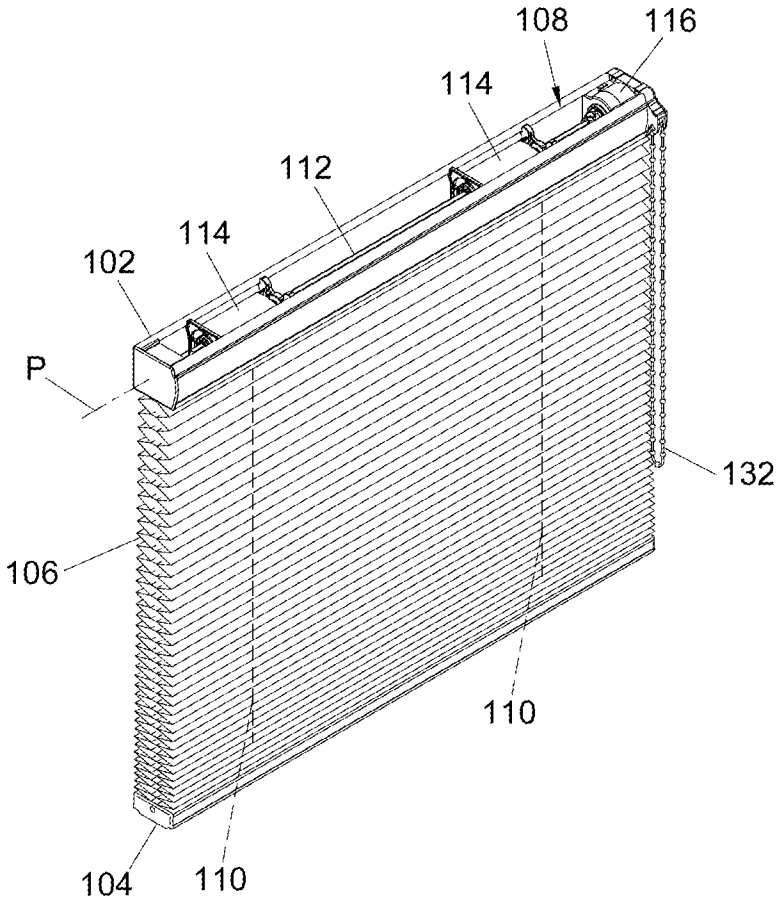
FIG. 3 is a perspective view illustrating the window shade having the bottom part lowered to a lowest position.
Figure 4:
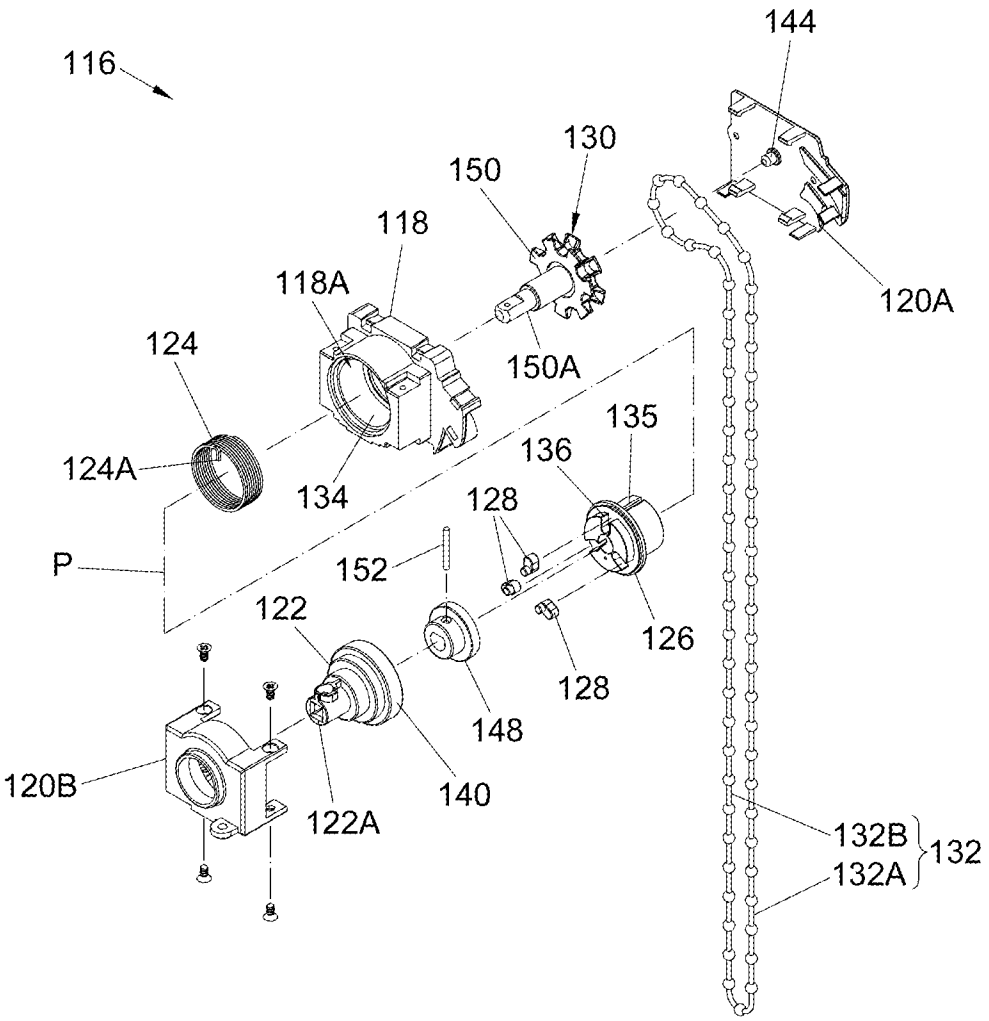
FIGS. 4 and 5 are two exploded views illustrating a construction of a control module under different angles of view.
Figure 5:
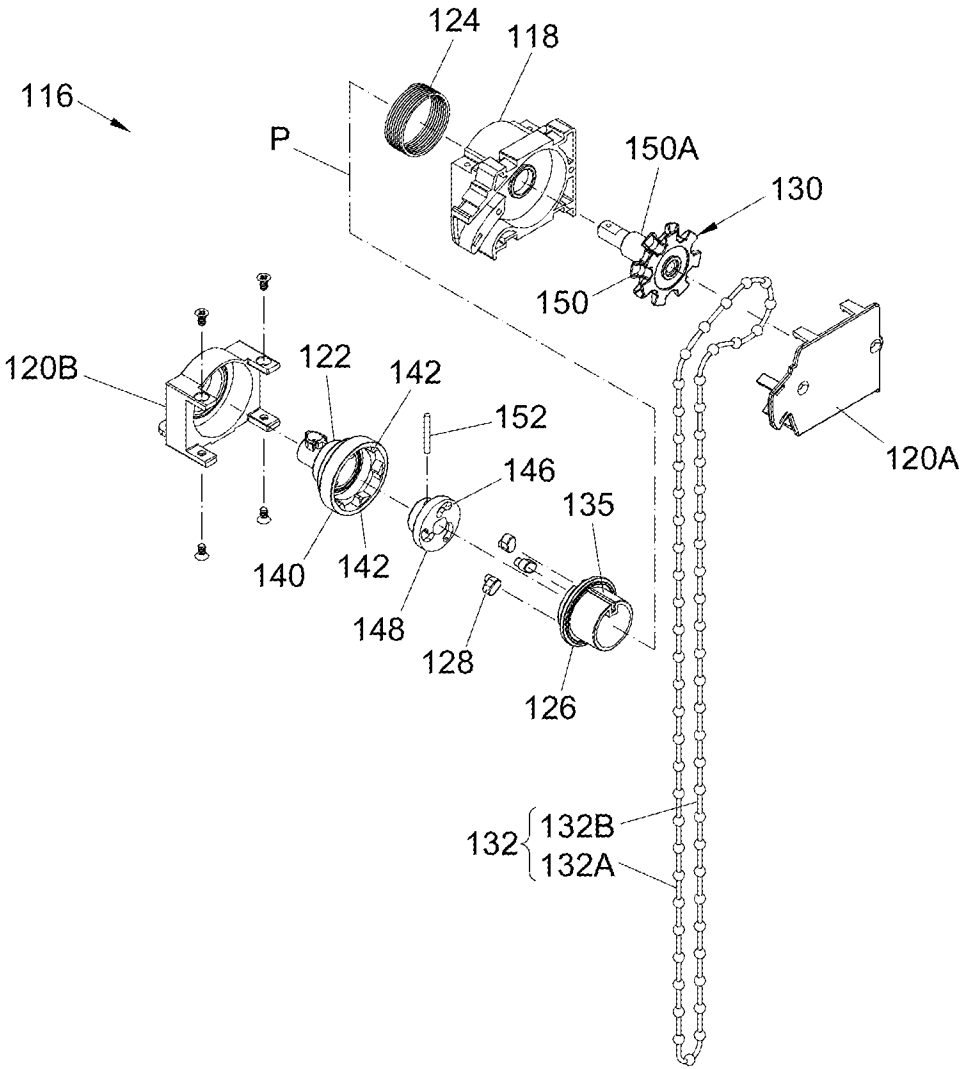

FIGS. 1-3 are perspective views illustrating an embodiment of a window shade 100 in different states. Referring to FIGS. 1-3, the window shade 100 can include a head rail 102, a bottom part 104, a shading structure 106 and an actuating system 108.

The head rail 102 may be affixed at a top of a window frame, and can have any desirable shapes. According to an example of construction, the head rail 102 can have an elongate shape including a cavity for at least partially receiving the actuating system 108 of the window shade 100.

The bottom part 104 can be suspended from the head rail 102 with a plurality of suspension elements 110 (shown with phantom lines in FIGS. 2 and 3). According to an example of construction, the bottom part 104 may be an elongate rail having a channel adapted to receive to the attachment of the shading structure 106. Examples of the suspension elements 110 may include, without limitation, cords, strips, bands, and the like.

The shading structure 106 may exemplary have a cellular structure, which may include, without limitation, honeycomb structures. However, it will be appreciated that the shading structure 106 may have any suitable structure that can be expanded and collapsed between the bottom part 104 and the head rail 102. The shading structure 106 can be suspended from the head rail 102, and can have two opposite ends respectively attached to the head rail 102 and the bottom part 104.

Referring to FIGS. 1-3, the bottom part 104 is movable vertically relative to the head rail 102 for setting the window shade 100 to a desirable configuration. For example, the bottom part 104 may be raised toward the head rail 102 to collapse the shading structure 106 as shown in FIG. 1, or lowered away from the head rail 102 to expand the shading structure 106 as shown in FIGS. 2 and 3. The vertical position of the bottom part 104 relative to the head rail 102 may be controlled with the actuating system 108.

Referring to FIGS. 1-3, the actuating system 108 is assembled with the head rail 102, and is operable to displace the bottom part 104 relative to the head rail 102 for adjustment. The actuating system 108 can include a transmission axle 112, a plurality of winding units 114 rotationally coupled to the transmission axle 112, and a control module 116 coupled to the transmission axle 112.

The transmission axle 112 is respectively coupled to the winding units 114, and can rotate about a pivot axis P. Each of the winding units 114 is respectively connected with the bottom part 104 via one suspension element 110, and is operable to wind the suspension element 110 for raising the bottom part 104 and to unwind the suspension element 110 for lowering the bottom part 104. For example, the winding unit 114 may include a rotary drum (not shown) that is rotationally coupled to the transmission axle 112 and is connected with one end of the suspension element 110, and another end of the suspension element 110 can be connected with the bottom part 104, whereby the rotary drum can rotate along with the transmission axle 112 to wind or unwind the suspension element 110. Since the winding units 114 are commonly coupled to the transmission axle 112, the winding units 114 can operate in a concurrent manner for winding and unwinding the suspension elements 110.

Figure 6:
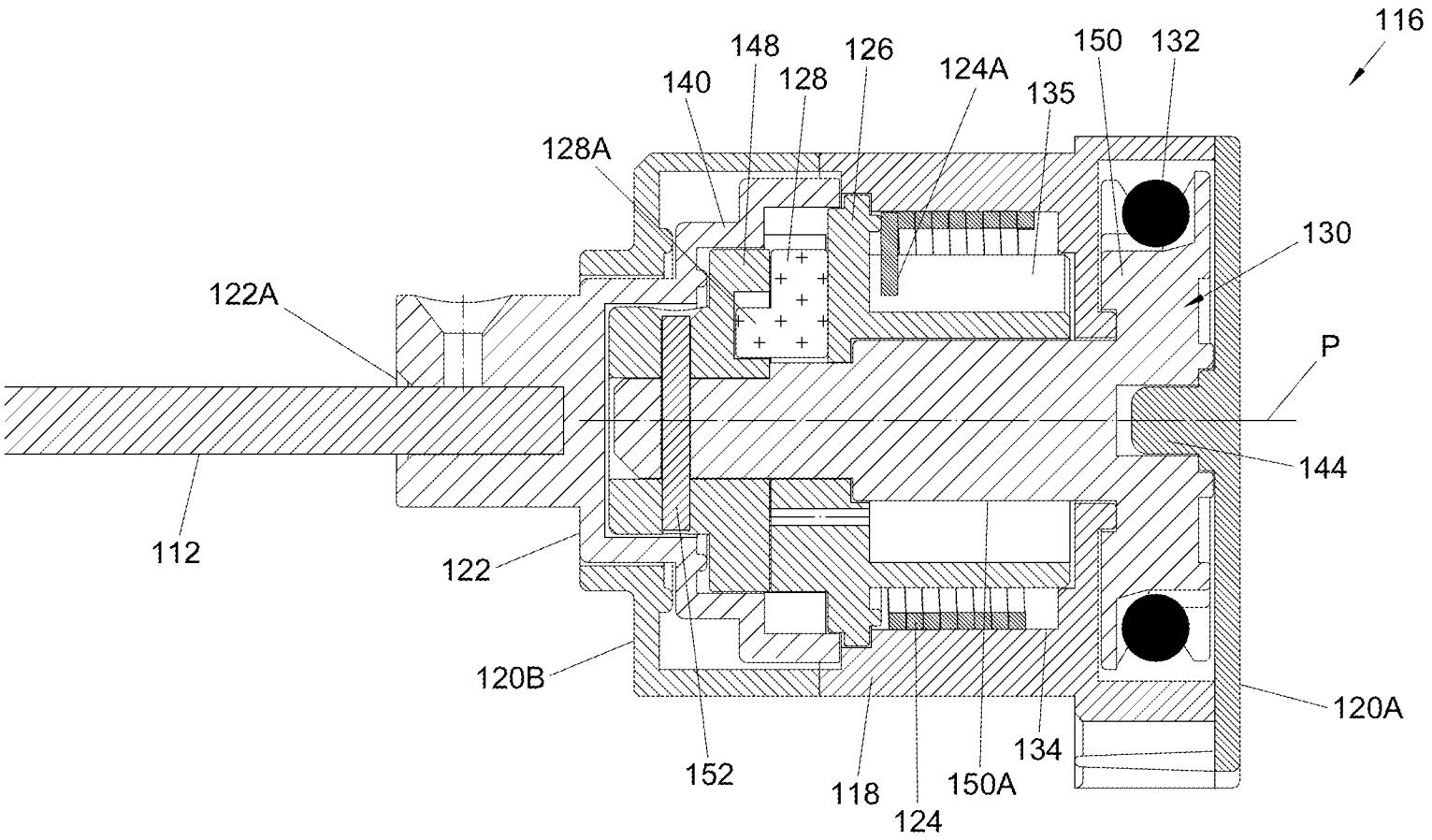
FIG. 6 is a cross-sectional view of the control module taken along a pivot axis.

The control module 116 is coupled to the transmission axle 112, and is operable to cause the transmission axle 112 to rotate in either direction about the pivot axis P for raising or lowering the bottom part 104. In conjunction with FIGS. 1-3, FIGS. 4 and 5 are two exploded views illustrating a construction of the control module 116 under different angles of view, and FIG. 6 is a cross-sectional view of the control module 116. Referring to FIGS. 1-6, the control module 116 can include a housing 118 that can be affixed to the head rail 102. The housing 118 can have a cavity 118A adapted to receive at least some component parts of the control module 116, wherein the cavity 118A can be respectively closed at a first side with a bracket 120A and at a second side opposite to the first side with a cover 120B.

Figure 8:
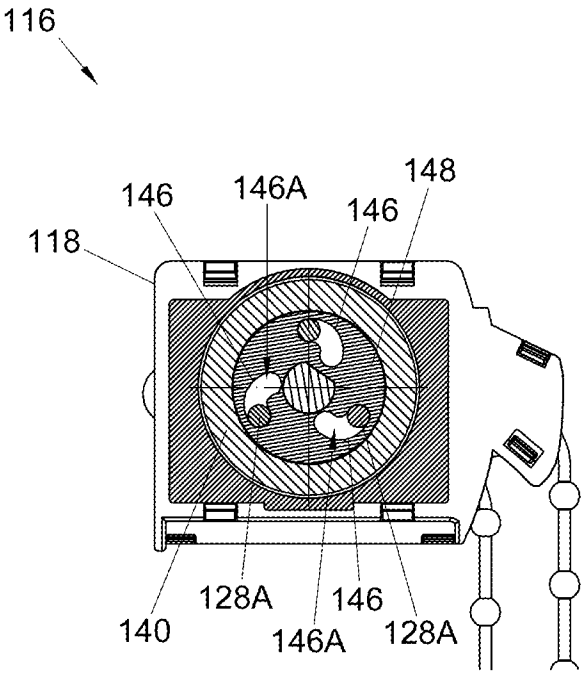
FIG. 8 is a cross-sectional view of the control module taken across a section that is perpendicular to the pivot axis and includes a connection of clutching parts with the actuating wheel.
Figure 7:
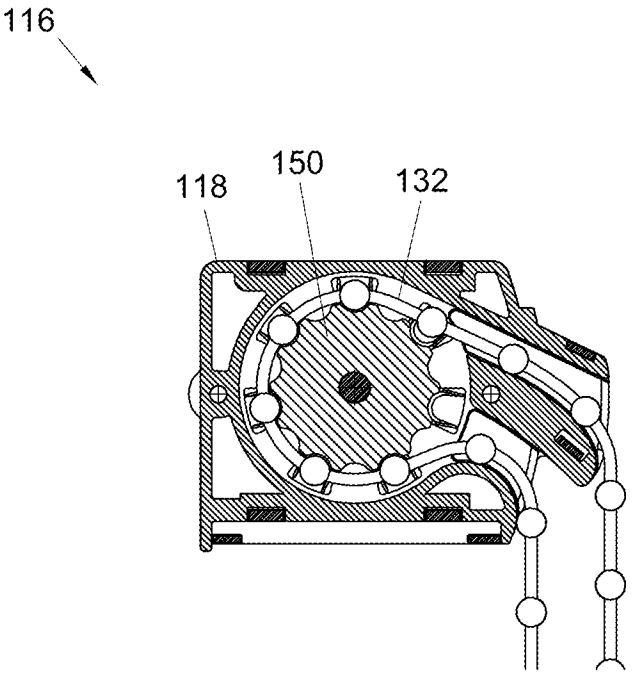
FIG. 7 is a cross-sectional view of the control module taken across a section that is perpendicular to the pivot axis and is adjacent to an operating element.
Figure 10:
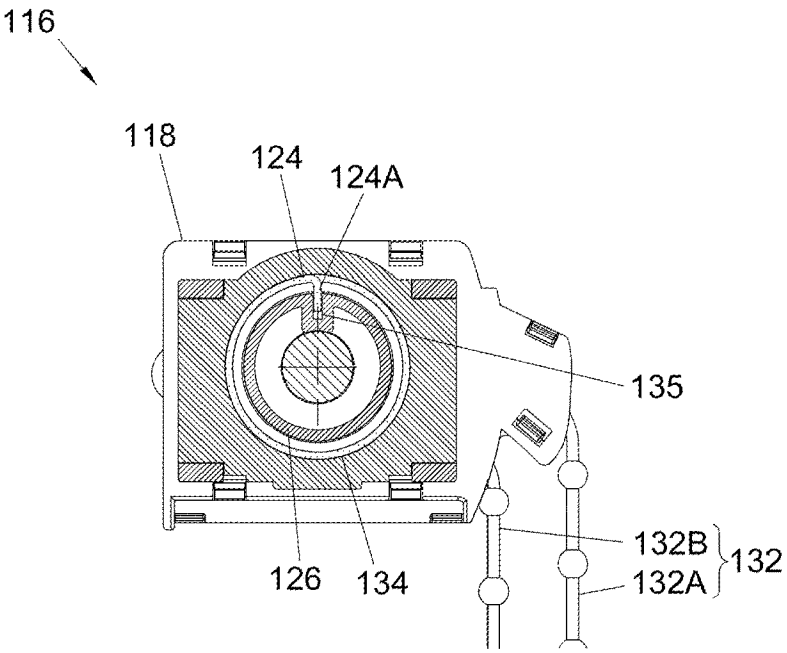
FIG. 10 is a cross-sectional view of the control module taken across a section that is perpendicular to the pivot axis and includes a connection of an arresting part with the arrester coupling part.
Figure 9:
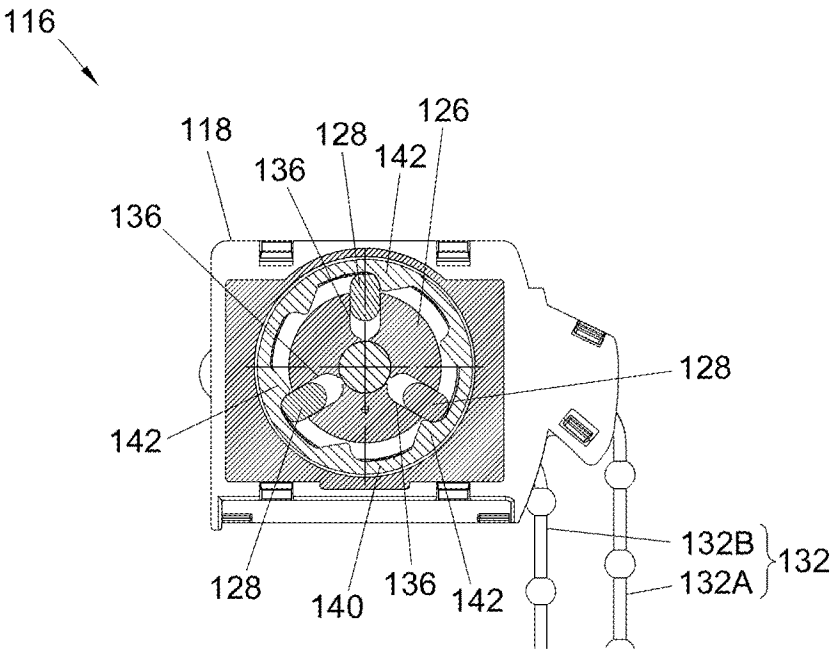
FIG. 9 is a cross-sectional view of the control module taken across a section that is perpendicular to the pivot axis and includes a connection of the clutching parts with an arrester coupling part.
Figure 11:
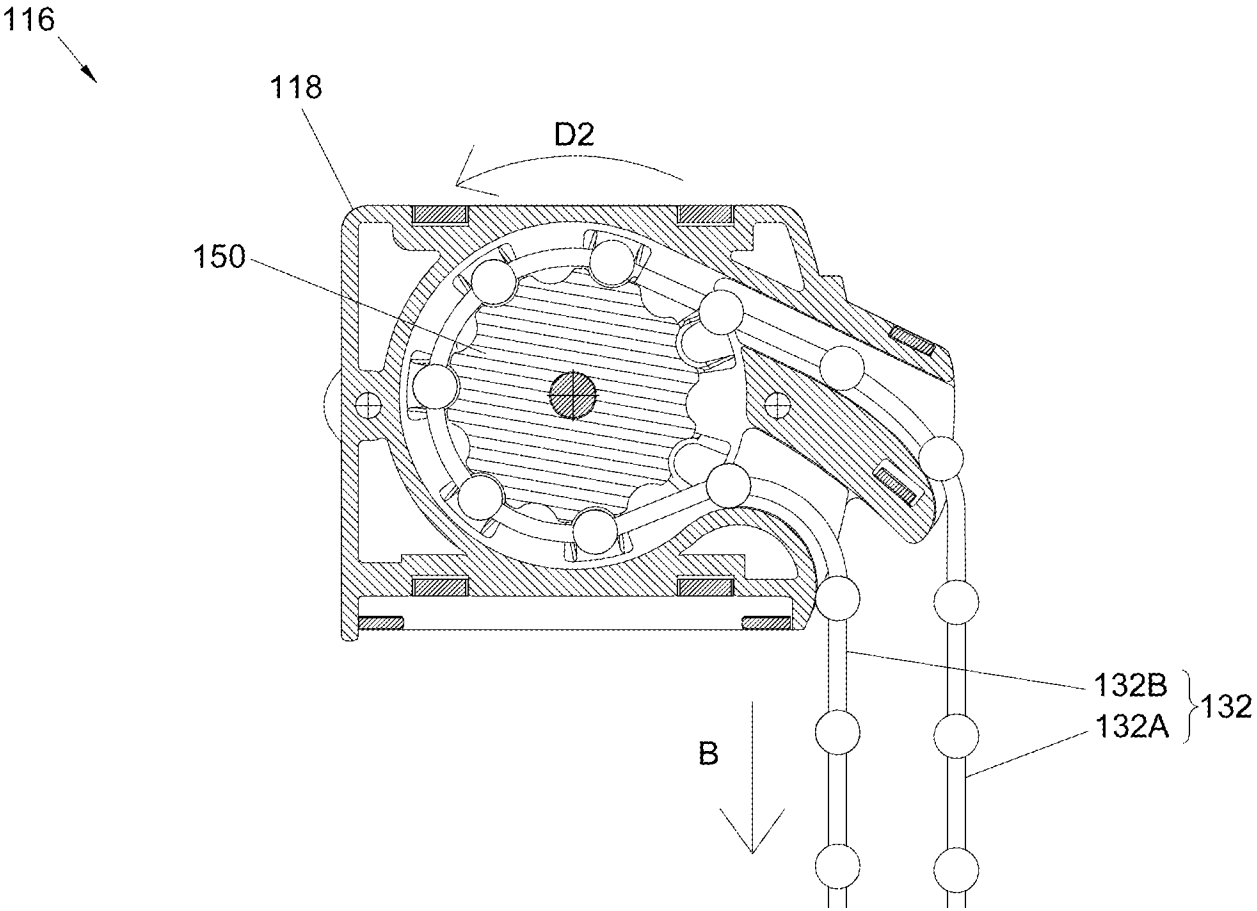
FIGS. 11-15 are schematic views illustrating exemplary operation of the control module for lowering a bottom part of the window shade.
Figure 14:
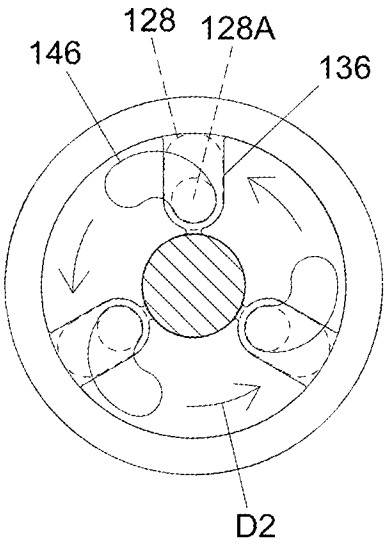
Figure 13:
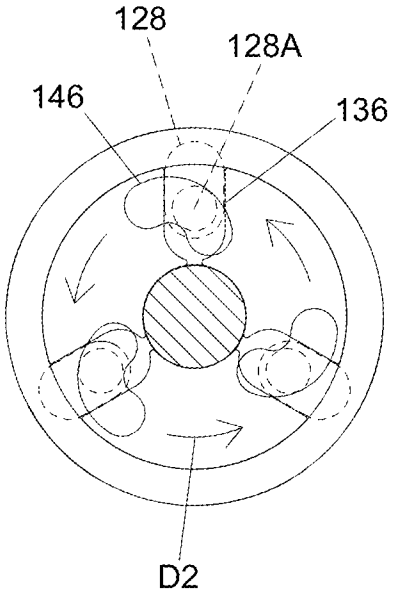
Figure 12:
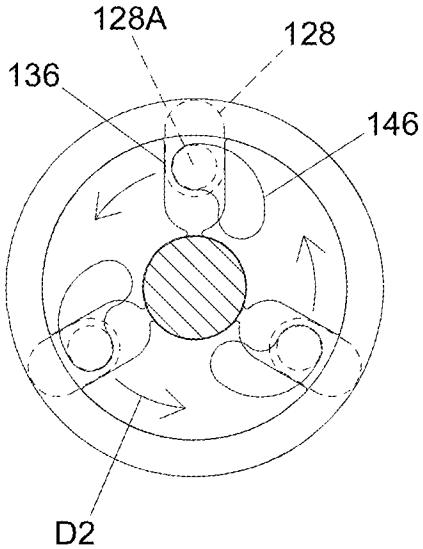
Figure 15:
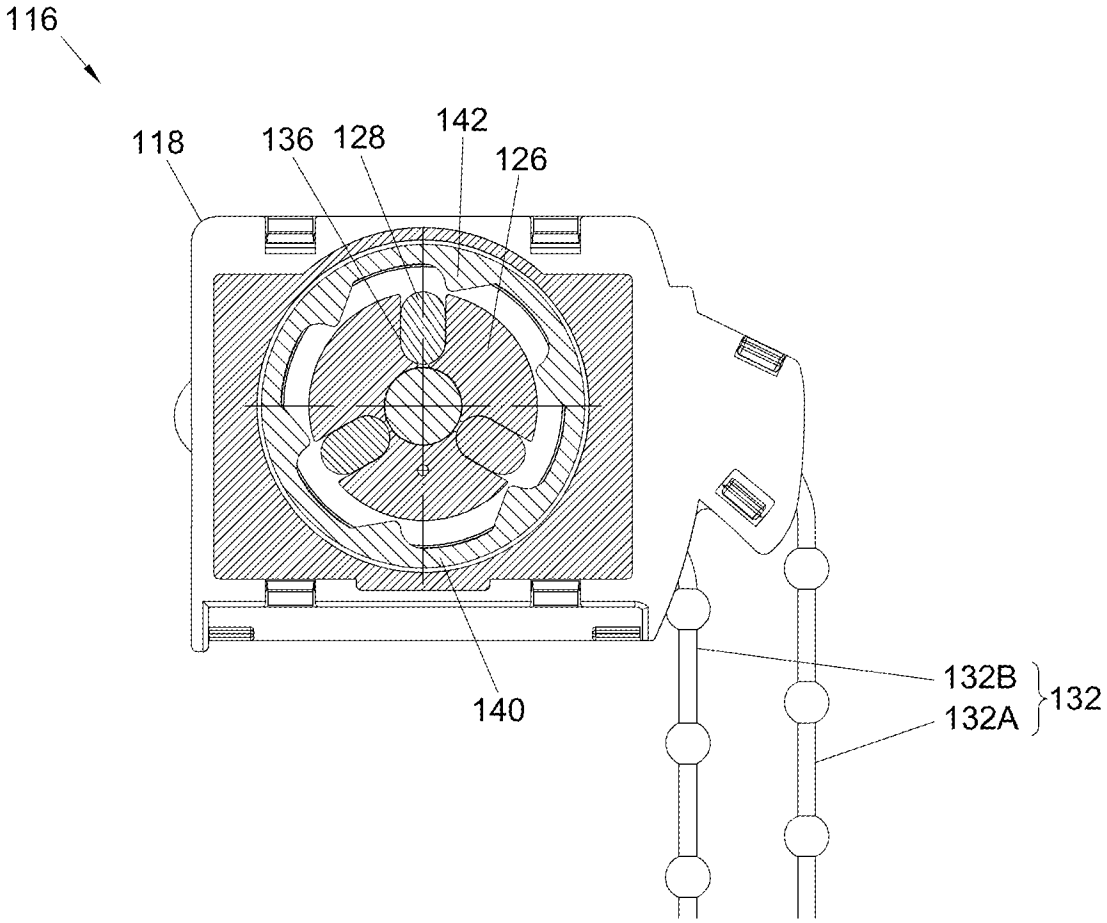
Figure 16:
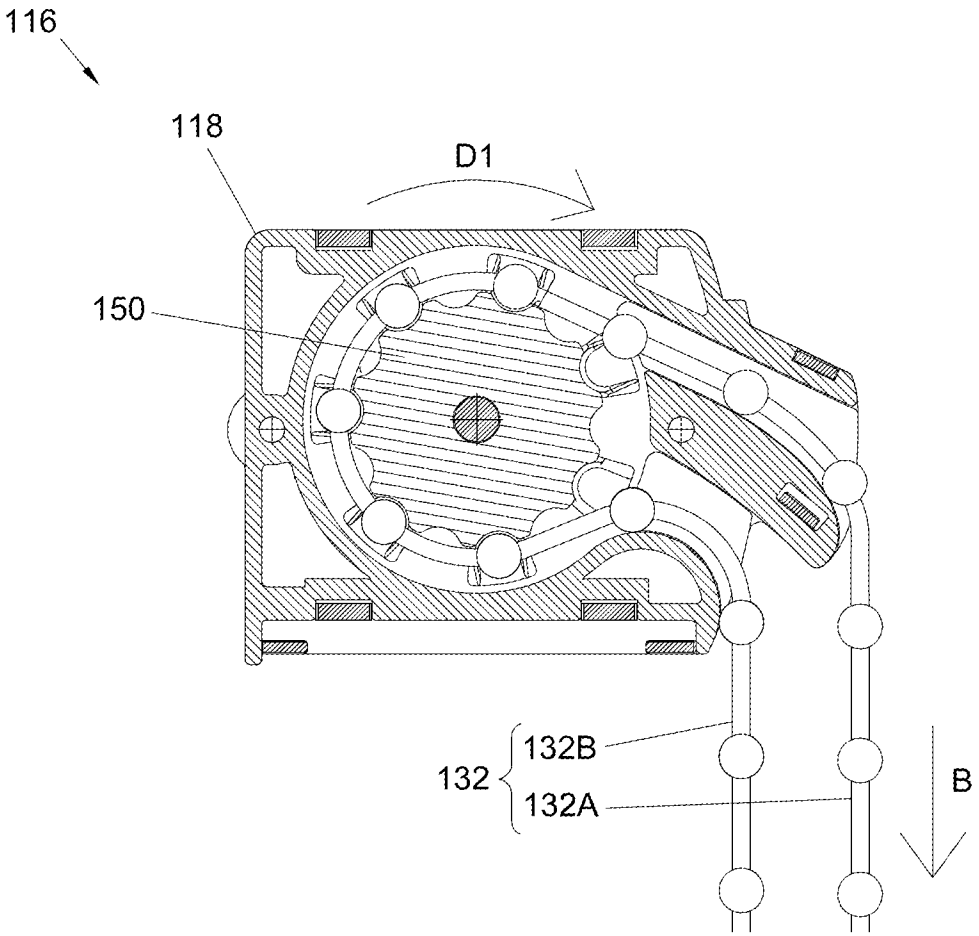
FIGS. 16-20 are schematic views illustrating exemplary operation of the control module for stopping the bottom part at a lowered position.
Figure 19:
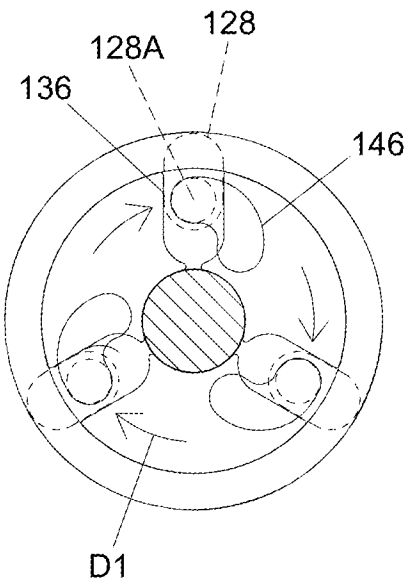
Figure 18:
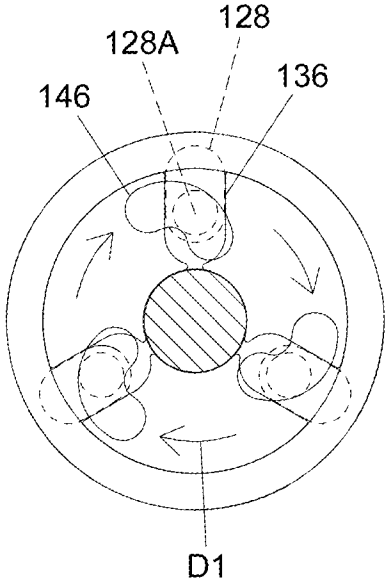
Figure 17:
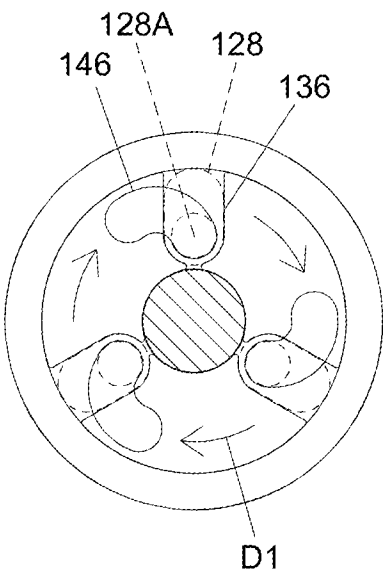
Figure 20:
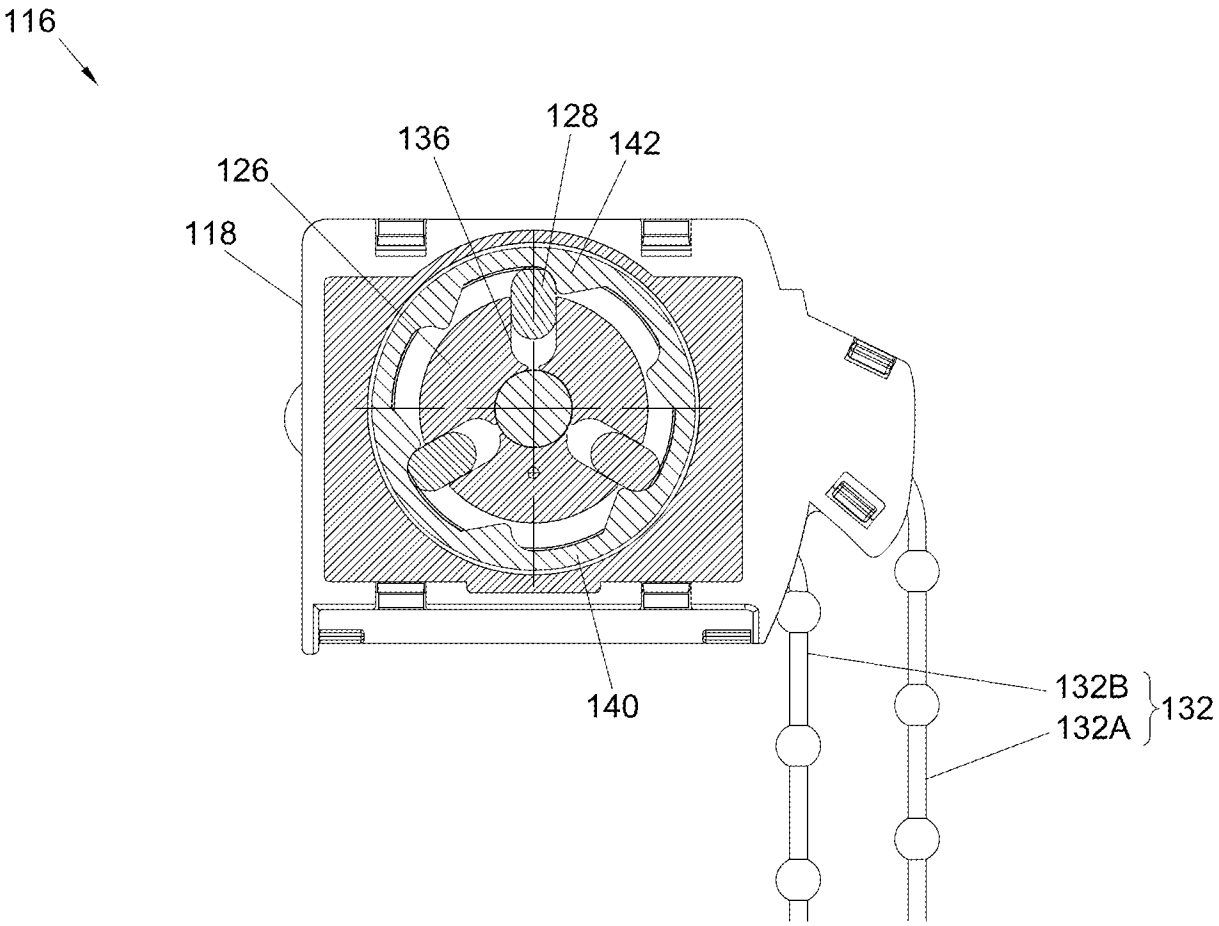

Referring to FIGS. 1-6, the control module 116 can include an axle coupling part 122, an arresting part 124, an arrester coupling part 126, a plurality of clutching parts 128, an actuating wheel 130 and an operating element 132. According to an example of construction, the axle coupling part 122, the arresting part 124, the arrester coupling part 126 and the actuating wheel 130 can be disposed substantially coaxial to the pivot axis P. In conjunction with FIGS. 4-6, FIGS. 7-10 are cross-sectional views of the control module 116 taken across different sections perpendicular to the pivot axis P. More specifically, FIG. 7 is a cross-sectional view of the control module 116 taken across a section that is perpendicular to the pivot axis P and is adjacent to the operating element 132. FIG. 8 is a cross-sectional view of the control module 116 taken across a section that is perpendicular to the pivot axis P and includes a connection of the clutching parts 128 with the actuating wheel 130. FIG. 9 is a cross-sectional view of the control module 116 taken across a section that is perpendicular to the pivot axis P and includes a connection of the clutching parts 128 with the arrester coupling part 126. FIG. 10 is a cross-sectional view of the control module 116 taken across a section that is perpendicular to the pivot axis P and includes a connection of the arresting part 124 with the arrester coupling part 126.

Referring to FIGS. 1-10, the axle coupling part 122 can be received at least partially inside the cavity 118A of the housing 118, and can extend outward through the cover 120B. The axle coupling part 122 is rotationally coupled to the transmission axle 112 so that the transmission axle 112 and the axle coupling part 122 can rotate in unison for raising or lowering the bottom part 104. For example, the transmission axle 112 can have an end that is received in an opening 122A provided in the axle coupling part 122, and a fastener (not shown) can be used to attach the transmission axle 112 to the axle coupling part 122. The transmission axle 112 and the axle coupling part 122 can thereby rotate in unison about the pivot axis P for raising or lowering the bottom part 104.

Referring to FIGS. 1-6, the arresting part 124 is configured to prevent rotation of the axle coupling part 122 in a direction that lowers the bottom part 104 so that the bottom part 104 can be held at any desirable position relative to the head rail 102. According to an example of construction, the arresting part 124 and the arrester coupling part 126 are connected with each other, and are disposed around the pivot axis P. More specifically, the arresting part 124 can be a spring that is disposed inside the housing 118 in tight contact with an inner wall 134 of the housing 118 and has an end 124A anchored to the arrester coupling part 126. For example, the arrester coupling part 126 can have a slot 135, and the end 124A of the arresting part 124 can be engaged with the slot 135. The arresting part 124 has a braking state where the arresting part 124 is expanded so that an outer circumference of the arresting part 124 is in frictional contact with the inner wall 134 of the housing 118, and a release state where the arresting part 124 is contracted so that the frictional contact of the arresting part 124 with the inner wall 134 of the housing 118 is loosened.

Referring to FIGS. 4-10, the arrester coupling part 126 is pivotally disposed inside the cavity 118A of the housing 118 axially adjacent to the axle coupling part 122 and the actuating wheel 130, and extends through the arresting part 124. The arrester coupling part 126 is rotatable about the pivot axis P as a single part. More specifically, the arrester coupling part 126 can rotate relative to the housing 118 to displace the end 124A of the arresting part 124 in a direction that contracts the arresting part 124 and thereby switches the arresting part 124 from the braking state to the release state, or to displace the end 124A in an opposite direction that expands the arresting part 124 and thereby switches the arresting part 124 from the release state to the braking state.

The clutching parts 128 are carried with the arrester coupling part 126, and are movable relative to the arrester coupling part 126 between a retracted state where the clutching parts 128 are disengaged from the axle coupling part 122 and an extended state where the clutching parts 128 are engaged with the axle coupling part 122. For example, the clutching parts 128 may be connected with the arrester coupling part 126 so as to be movable generally orthogonal to the pivot axis P between the retracted state and the extended state.

According to an example of construction, the clutching parts 128 can be respectively connected slidably with the arrester coupling part 126, and can be disposed distant from the pivot axis P at different angular positions on the arrester coupling part 126. For example, the arrester coupling part 126 can have a plurality of channels 136 that are disposed at different angular positions distant from the pivot axis P and are opened on a circumference of the arrester coupling part 126, and the clutching parts 128 can be respectively guided for sliding movement in the channels 136. The clutching parts 128 can thereby slide relative to the arrester coupling part 126 generally orthogonal to the pivot axis P to protrude outward from the circumference of the arrester coupling part 126 in the extended state or retract toward the interior of the arrester coupling part 126 in the retracted state. Moreover, the clutching parts 128 can move along with the arrester coupling part 126 around the pivot axis P when the arrester coupling part 126 rotates about the pivot axis P.

According to an example of construction, the axle coupling part 122 can include a sleeve 140 having a plurality of teeth 142 protruding inward from an inner wall of the sleeve 140, and the arrester coupling part 126 can be at least partially received inside the sleeve 140. The clutching parts 128 can respectively engage with the teeth 142 in the extended state, and can respectively disengage from the teeth 142 in the retracted state.

Referring to FIGS. 4-10, the actuating wheel 130 can be disposed inside the cavity 118A of the housing 118 substantially coaxial to the transmission axle 112. For example, the bracket 120A can have a fixed shaft 144, and the actuating wheel 130 can be pivotally connected around the fixed shaft 144 so as to be rotatable about the pivot axis P of the transmission axle 112.

The operating element 132 is a flexible closed-loop element, and is coupled to the actuating wheel 130. Examples of the operating element 132 can include, without limitation, a bead chain or a cord loop. The operating element 132 can loop around the actuating wheel 130, and can have two portions 132A and 132B exposed outside the head rail 102 for operation by a user. One of the two portions 132A and 132B of the operating element 132 can be pulled downward to cause the actuating wheel 130 to rotate in one direction, and the other one of the two portions 132A and 132B of the operating element 132 can be pulled downward to cause the actuating wheel 130 to rotate in another opposite direction.

Referring to FIGS. 4-10, the actuating wheel 130 is movably linked to the clutching parts 128 so that the actuating wheel 130 is rotatable to switch the clutching parts 128 between the retracted state and the extended state. According to an example of construction, the clutching parts 128 can be slidably connected with the actuating wheel 130. For example, the actuating wheel 130 can have a plurality of driving portions 146 provided at different eccentric locations relative to the pivot axis P, and the clutching parts 128 can be respectively connected slidably with the driving portions 146. For facilitating the connection of the clutching parts 128 with the actuating wheel 130, the actuating wheel 130 can have a coupling portion 148 and a wheel portion 150 that can be fixedly attached to each other via a fastener 152, the driving portions 146 can be provided in the coupling portion 148, and the wheel portion 150 can be connected with the operating element 132. The coupling portion 148 of the actuating wheel 130 can be received at least partially inside the sleeve 140 of the axle coupling part 122, and the wheel portion 150 can have a shaft 150A that extends through the arrester coupling part 126 and is attached to the coupling portion 148 with the fastener 152. Each of the driving portions 146 can have a guide slot 146A, and each of the clutching parts 128 can have a pin 128A that is slidably received in the guide slot 146A of the corresponding driving portion 146. The driving portions 146 can be disposed so that the guide slots 146A respectively overlap at least partially with the channels 136 of the arrester coupling part 126. Moreover, the mutually-overlapping channel 136 and guide slot 146A can extend in different directions so that the rotation of the actuating wheel 130 in either direction can urge the clutching parts 128 to concurrently slide relative to the arrester coupling part 126 for switching between the retracted state and the extended state.

With the aforementioned construction, the actuating wheel 130 is rotatable in a first direction to urge the clutching parts 128 to move from the retracted state to the extended state, and in a second direction opposite to the first direction to urge the clutching parts 128 to move from the extended state to the retracted state. When the clutching parts 128 are in the extended state, the braking state of the arresting part 124 is applicable to prevent rotation of the axle coupling part 122 in a direction that lowers the bottom part 104 of the window shade 100. Moreover, the actuating wheel 130 is rotatable in the first direction to drive the axle coupling part 122 and the arrester coupling part 126 to rotate in unison with the clutching parts 128 in the extended state for switching the arresting part 124 from the braking state to the release state and raising the bottom part 104 of the window shade 100. When the clutching parts 128 are in the retracted state, the axle coupling part 122 is rotationally decoupled from the arrester coupling part 126 and the actuating wheel 130 and is therefore rotatable along with the transmission axle 112 for lowering the bottom part 104 owing to gravity action. A user can pull one of the two portions 132A and 132B of the operating element 132 (e.g., the portion 132A) downward for rotating the actuating wheel 130 in the first direction, and can pull the other one of the two portions 132A and 132B of the operating element 132 (e.g., the portion 132B) downward for rotating the actuating wheel 130 in the second direction.

In conjunction with FIGS. 1-10, FIGS. 11-20 are schematic views illustrating exemplary operation of the control module 116 for lowering the bottom part 104 of the window shade 100 to a desired lower position, wherein FIGS. 11-15 are schematic views illustrating exemplary operation of the control module 116 for lowering the bottom part 104, and FIGS. 16-20 are schematic views illustrating exemplary operation of the control module 116 for stopping the bottom part 104 at the desired lower position. Referring to FIGS. 4-6 and 7-10, suppose that the bottom part 104 of the window shade 100 is in a stationary position, e.g., the raised position shown in FIG. 1. The arresting part 124 is in the braking state, and the clutching parts 128 are in the extended state. Owing to the engagement of the clutching parts 128 with the axle coupling part 122, the transmission axle 112 and the axle coupling part 122 are rotationally coupled to the arrester coupling part 126, and the arresting part 124 can apply a braking force on the arrester coupling part 126 that counteracts a torque created by the weight load of the bottom part 104. Accordingly, the bottom part 104 can be held in position.

Referring to FIGS. 1, 4-6 and 11-15, for lowering the bottom part 104, a user slightly pulls one of the two portions 132A and 132B (e.g., the portion 132B) of the operating element 132 downward in a direction B and then release it. As a result, the actuating wheel 130 rotates an angle in a direction D2 that causes the clutching parts 128 to move from the extended state to the retracted state, which rotationally decouples the transmission axle 112 and the axle coupling part 122 from the arrester coupling part 126 and the actuating wheel 130. This is schematically illustrated in FIGS. 12-15. Since the braking force of the arresting part 124 no longer applies on the axle coupling part 122, the transmission axle 112 and the axle coupling part 122 can rotate in unison as the bottom part 104 lowers by gravity action. The arresting part 124, the arrester coupling part 126, the clutching parts 128 and the actuating wheel 130 can remain generally stationary while the transmission axle 112 and the axle coupling part 122 rotate for lowering the bottom part 104.

Referring to FIGS. 2, 4-6 and 16-20, when the bottom part 104 moving downward reaches a desired position, the user slightly pulls the other one of the two portions 132A and 132B (e.g., the portion 132A) of the operating element 132 downward in the direction B and then release it. As a result, the actuating wheel 130 rotates an angle in a direction D1 opposite to the direction D2 that causes the clutching parts 128 to move from the retracted state to the extended state. As the clutching parts 128 in the extended state engage with the axle coupling part 122, the transmission axle 112 and the axle coupling part 122 are rotationally coupled to the arrester coupling part 126, and the braking force applied by the arresting part 124 can counteract the torque imparted by the weight load of the bottom part 104. Accordingly, the bottom part 104 can be held in the desired position.

For raising the bottom part 104, the user continuously pulls the other one of the two portions 132A and 132B (e.g., the portion 132A) of the operating element 132 downward. As a result, the actuating wheel 130 continuously rotates in the direction D1 and drives the axle coupling part 122 and the arrester coupling part 126 to rotate in unison in the same direction with the clutching parts 128 in the extended state and engaged with the teeth 142 inside the axle coupling part 122, which can switch the arresting part 124 from the braking state to the release state and raise the bottom part 104. The arresting part 124 can rotate in unison with the arrester coupling part 126 and the actuating wheel 130 as the bottom part 104 rises.

Once the rising bottom part 104 reaches a desired position, the user can release the operating element 132. As a result, the arresting part 124 switches from the release state to the braking state. Since the clutching parts 128 are in the extended state and are engaged with the axle coupling part 122, the transmission axle 112 and the axle coupling part 122 are rotationally coupled to the arrester coupling part 126, and the braking force applied by the arresting part 124 can counteract the torque imparted by the weight load of the bottom part 104. Accordingly, the bottom part 104 can be held in the desired position.

Figure 21:
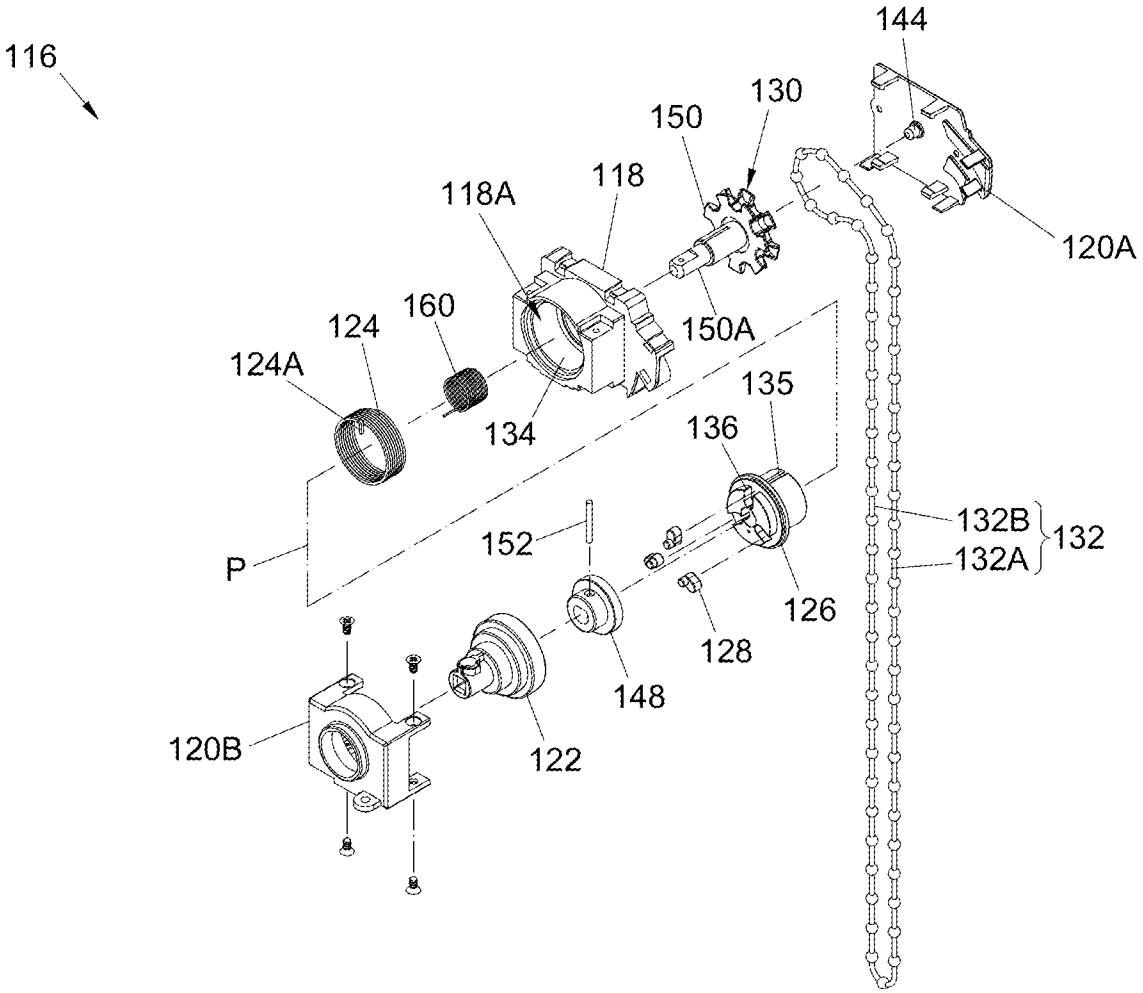
FIGS. 21 and 22 are two exploded views illustrating a variant construction of the control module under different angles of view.
Figure 22:
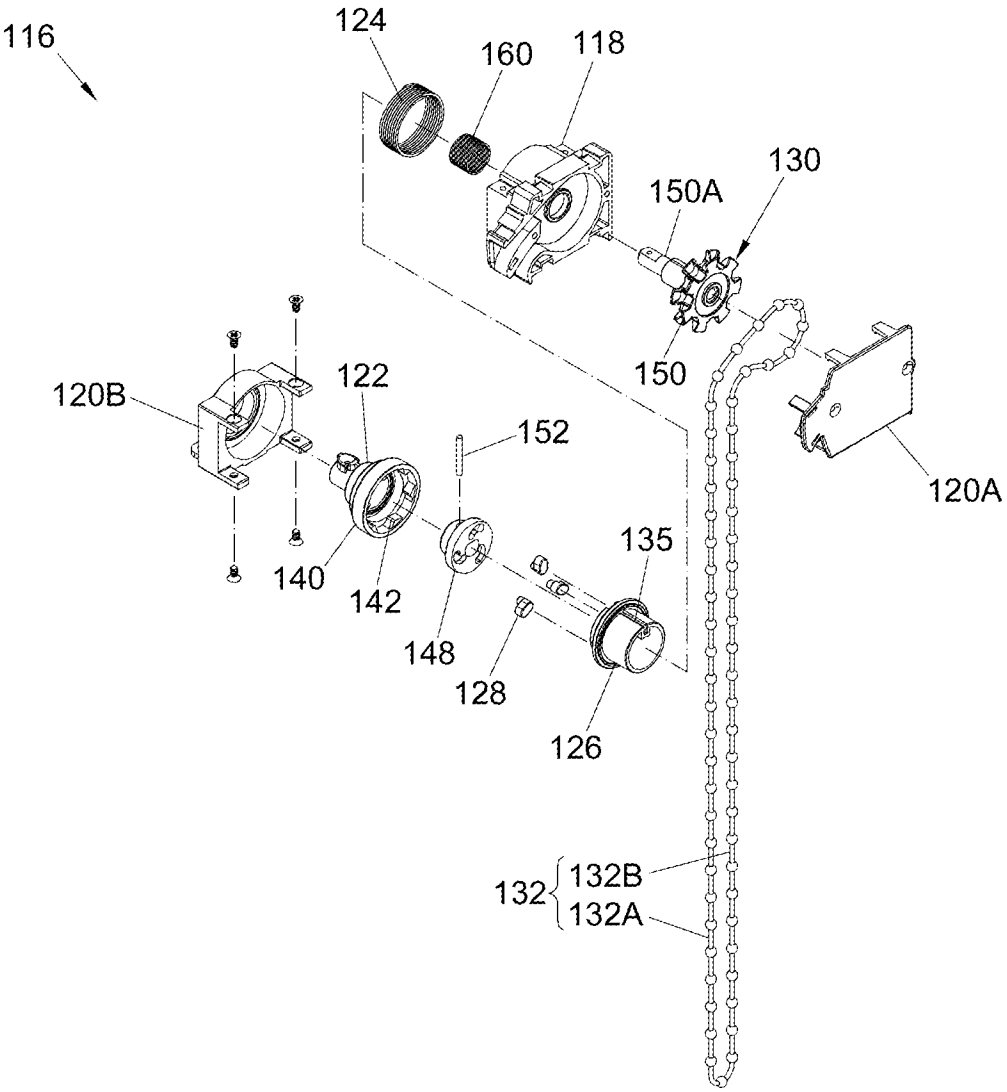
Figure 23:
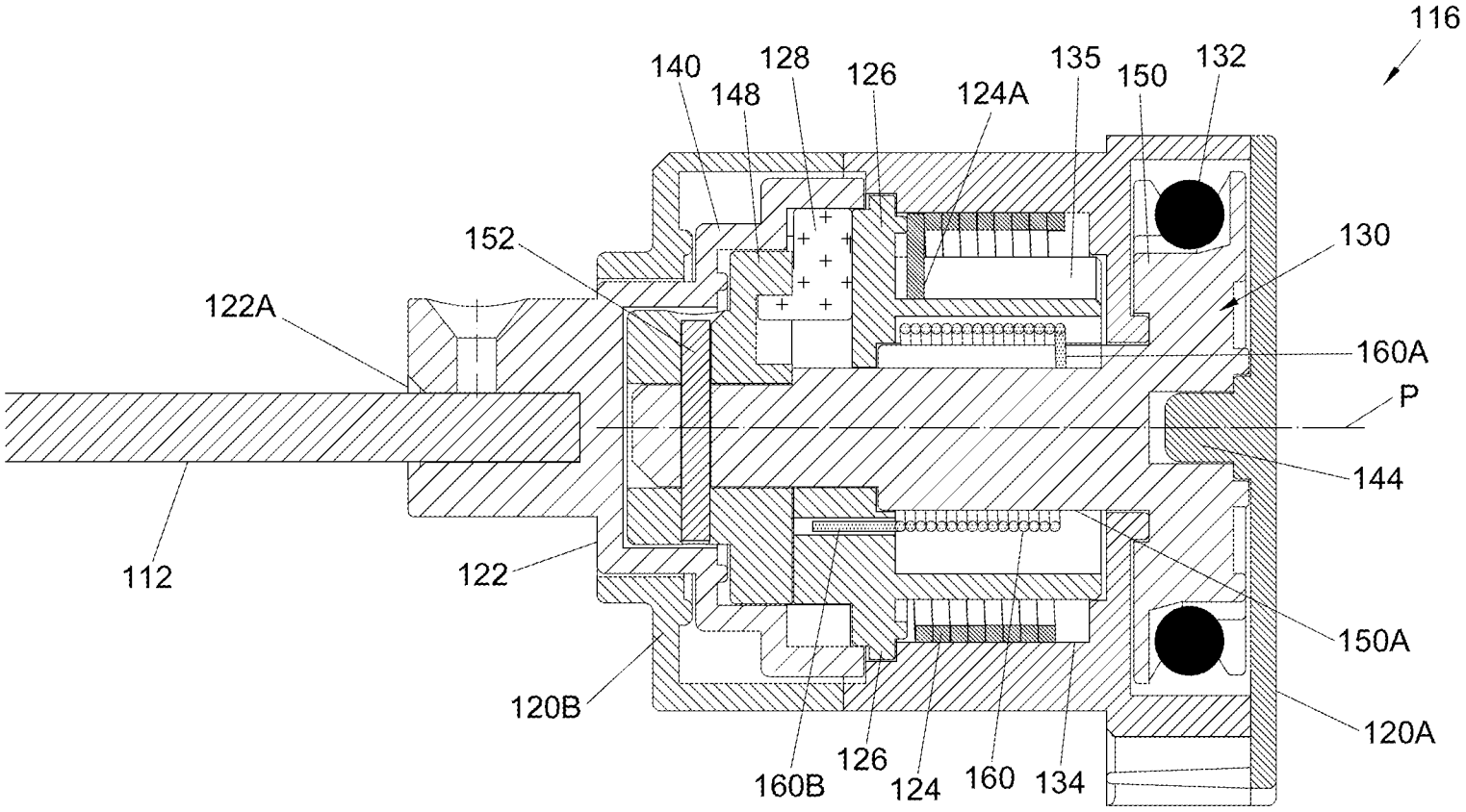
FIG. 23 is a cross-sectional view of the control module shown in FIGS. 21 and 22.

FIGS. 21 and 22 are two exploded views illustrating a variant construction of the control module 116 under different angles of view, and FIG. 23 is a cross-sectional view of the control module 116 shown in FIGS. 21 and 22. Referring to FIGS. 21-23, the control module 116 shown therein is similar to the embodiment described previously and further includes a spring 160 connected with the actuating wheel 130, wherein the spring 160 can apply a biasing force on the actuating wheel 130 in the direction D1 (better show in FIGS. 16-19) for assisting in maintaining the clutching parts 128 in the extended state. According to an example of construction, the spring 160 has one end 160A connected with the actuating wheel 130 and another end 160B connected with the arrester coupling part 126. In conjunction with FIGS. 1-3, exemplary operation of the control module 116 shown in FIGS. 21-23 is described hereinafter.

For lowering the bottom part 104, a user slightly pulls the portion 132B of the operating element 132 downward to a pull position and then maintains it in the pull position. As a result, the actuating wheel 130 rotates an angle in the direction D2 against the biasing force of the spring 160 so that the clutching parts 128 are urged to move from the extended state to the retracted state, like previously described. Since the braking force applied by the arresting part 124 no longer applies on the axle coupling part 122, the transmission axle 112 and the axle coupling part 122 can rotate in unison as the bottom part 104 lowers by gravity action. The arresting part 124, the arrester coupling part 126, the clutching parts 128 and the actuating wheel 130 can remain generally stationary while the transmission axle 112 and the axle coupling part 122 rotate for lowering the bottom part 104.

When the bottom part 104 moving downward reaches a desired position, the user releases the operating element 132. As a result, the actuating wheel 130 rotates an angle in the direction D1 owing to the biasing force of the spring 160, which causes the clutching parts 128 to move from the retracted state to the extended state. As the clutching parts 128 in the extended state engage with the axle coupling part 122, the transmission axle 112 and the axle coupling part 122 are rotationally coupled to the arrester coupling part 126, and the braking force applied by the arresting part 124 can counteract the torque imparted by the weight load of the bottom part 104. Accordingly, the bottom part 104 can be held in the desired position.

For raising the bottom part 104, the user continuously pulls the other portion 132A of the operating element 132 downward. As a result, the actuating wheel 130 continuously rotates in the direction D1 and drives the axle coupling part 122 and the arrester coupling part 126 to rotate in unison in the same direction with the clutching parts 128 in the extended state and engaged with the teeth 142 inside the axle coupling part 122, which can switch the arresting part 124 from the braking state to the release state and raise the bottom part 104. The arresting part 124 and the spring 160 can rotate in unison with the arrester coupling part 126 and the actuating wheel 130 as the bottom part 104 rises.

Once the rising bottom part 104 reaches a desired position, the user can release the operating element 132. As a result, the arresting part 124 switches from the release state to the braking state. Since the clutching parts 128 are in the extended state and are engaged with the axle coupling part 122, the transmission axle 112 and the axle coupling part 122 are rotationally coupled to the arrester coupling part 126, and the braking force applied by the arresting part 124 can counteract the torque imparted by the weight load of the bottom part 104. Accordingly, the bottom part 104 can be held in the desired position.

Figure 24:
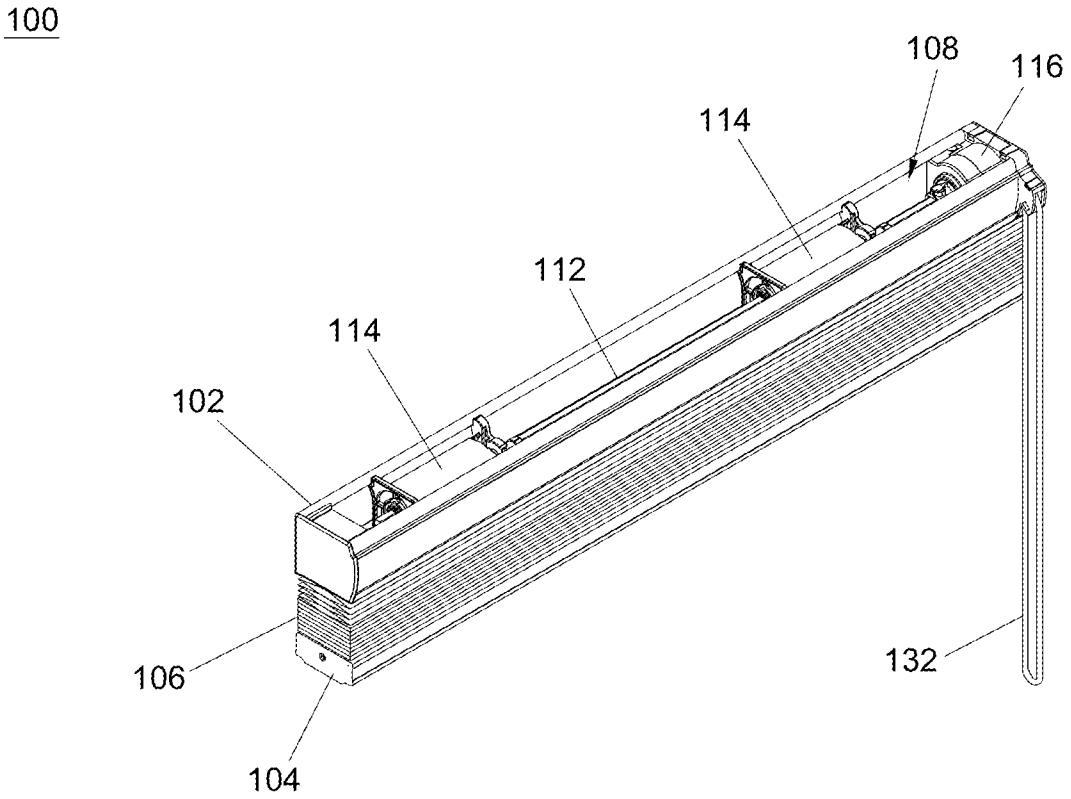
FIG. 24 is a perspective view illustrating a variant construction in which an operating element of the control module is a cord loop having no beads.

FIG. 24 is a perspective view illustrating a variant construction in which the operating element 132 of the control module 116 provided in the window shade 100 is a cord loop having no beads. The other components of the control module 116 shown in FIG. 24 may be similar to the constructions described previously.

Advantages of the structures described herein include the ability to provide an actuating system operable to lower and raise a bottom part of the window shade with a single operating element. The actuating system uses a closed-loop operating element, wherein a portion of the operating element can be slightly pulled downward for lowering the bottom part, and another portion of the operating element can be continuously pulled downward for raising the bottom part. Accordingly, the actuating system is convenient to operate, and is relatively simple in construction.

Realizations of the structures have been described only in the context of particular embodiments. These embodiments are meant to be illustrative and not limiting. Many variations, modifications, additions, and improvements are possible. Accordingly, plural instances may be provided for components described herein as a single instance. Structures and functionality presented as discrete components in the exemplary configurations may be implemented as a combined structure or component. These and other variations, modifications, additions, and improvements may fall within the scope of the claims that follow.

What is claimed is:

1. An actuating system for a window shade, comprising:

a housing;

an axle coupling part rotatable relative to the housing for raising or lowering a bottom part of a window shade, the axle coupling part having a sleeve configured to rotationally couple to an axle;

an arresting part and an arrester coupling part connected with each other, the arrester coupling part being a single body having an outer surface and the arresting part having an end connected with the outer surface of the arrester coupling part, the arresting part being disposed in the housing and having a braking state and a release state, the arresting part having a surface that is in frictional contact with the housing in the braking state, the frictional contact between the surface of the arresting part and the housing being loosened in the release state;

a clutching part carried with the arrester coupling part and having a protrusion, the clutching part being movable relative to the arrester coupling part between a retracted state where the protrusion of the clutching part is retracted toward the arrester coupling part and disengaged from the sleeve of the axle coupling part, and an extended state where the protrusion of the clutching part extends outward from the arrester coupling part and is engaged with the sleeve of the axle coupling part; and an actuating wheel movably linked to the clutching part, the actuating wheel being rotatable in a first direction to urge the clutching part to move from the retracted state to the extended state, and in a second direction opposite to the first direction to urge the clutching part to move from the extended state to the retracted state.

2. The actuating system according to claim 1, wherein the braking state of the arresting part applies a braking force on the arrester coupling part that is adapted to prevent rotation of the axle coupling part in a direction that lowers a bottom part of a window shade when the clutching part is in the extended state, and the axle coupling part is rotationally decoupled from the arrester coupling part and the actuating wheel when the clutching part is in the retracted state.

3. The actuating system according to claim 1, wherein the actuating wheel is rotatable in the first direction to drive the arrester coupling part and the axle coupling part to rotate in unison with the clutching part in the extended state for switching the arresting part from the braking state to the release state and raising a bottom part of a window shade.

4. The actuating system according to claim 1, wherein the axle coupling part, the arrester coupling part and the actuating wheel are disposed substantially coaxial.

5. The actuating system according to claim 1, wherein the clutching part is respectively connected slidably with the arrester coupling part and the actuating wheel.

6. The actuating system according to claim 5, wherein the actuating wheel is rotatable about a pivot axis and has a driving portion at an eccentric location, and the clutching part is slidably connected with the driving portion.

7. The actuating system according to claim 6, wherein the driving portion has a guide slot, and the clutching part has a pin slidably received in the guide slot.

8. The actuating system according to claim 7, wherein the arrester coupling part has a channel in which the clutching part is guided for sliding movement, and the guide slot overlaps at least partially with the channel.

9. The actuating system according to claim 1, wherein the sleeve has a tooth protruding inward, the arrester coupling part and the axle coupling part being rotatable in unison with the clutching part engaged with the tooth.

10. The actuating system according to claim 9, wherein the arrester coupling part is at least partially received inside the sleeve of the axle coupling part, and the clutching part protrudes outward from a circumference of the arrester coupling part in the extended state for engaging with the tooth of the sleeve.

11. The actuating system according to claim 1, wherein the arresting part is a spring that is disposed in contact with the housing and has an end anchored to the arrester coupling part, the spring being in frictional contact with the housing in the braking state, the frictional contact of the spring with the housing being loosened in the release state.

12. The actuating system according to claim 1, further including a spring connected with the actuating wheel, the spring applying a biasing force on the actuating wheel in the first direction for assisting in maintaining the clutching part in the extended state.

13. The actuating system according to claim 12, wherein the spring has a first end connected with the actuating wheel and a second end connected with the arrester coupling part.

14. The actuating system according to claim 1, wherein the actuating wheel is coupled to a closed-loop operating element.

15. The actuating system according to claim 14, wherein the operating element is a bead chain or a cord loop.

16. The actuating system according to claim 1, further including a transmission axle rotationally coupled to the axle coupling part, and at least one winding unit that is coupled to the transmission axle and is connected with a suspension element.

17. A window shade comprising:

a head rail;

a shading structure and a bottom part suspended from the head rail; and the actuating system according to claim 16, wherein the bottom part is connected with the suspension element.

* * * * *